US009573719B2

(12) United States Patent
Deering et al.

(10) Patent No.: US 9,573,719 B2
(45) Date of Patent: Feb. 21, 2017

(54) END LOAD CARTON WITH CLOSURE SYSTEM

(71) Applicant: General Mills, Inc., Minneapolis, MN (US)

(72) Inventors: Curtis J Deering, Eden Prairie, MN (US); Elizabeth Nordstrum, Sunnyvale, CA (US); Felicia A Pinkstone, Aston, PA (US)

(73) Assignee: General Mills, Inc., Minneapolis, MN (US)

( * ) Notice: Subject to any disclaimer, the term of this patent is extended or adjusted under 35 U.S.C. 154(b) by 67 days.

(21) Appl. No.: 14/279,383

(22) Filed: May 16, 2014

(65) Prior Publication Data

US 2015/0329236 A1 Nov. 19, 2015

(51) Int. Cl.
*B65D 5/06* (2006.01)
*B65D 5/02* (2006.01)
*B65D 5/10* (2006.01)

(52) U.S. Cl.
CPC ..... *B65D 5/06* (2013.01); *B65D 5/0227* (2013.01); *B65D 5/106* (2013.01)

(58) Field of Classification Search
USPC ..... 229/138, 137, 222, 102, 150, 128, 156, 229/184, 125.32
See application file for complete search history.

(56) References Cited

U.S. PATENT DOCUMENTS 882,688 A 3/1908 Janicke
2,151,202 A * 3/1939 Guyer ..... 229/246
2,162,556 A * 6/1939 Lagaard ..... 229/246
3,201,026 A 8/1965 Travis et al.
3,366,311 A * 1/1968 Simpson ..... B65D 5/0227 229/155
3,542,281 A 11/1970 Field
3,549,082 A 12/1970 Simpson
3,797,728 A 3/1974 Buttery et al.
4,308,995 A 1/1982 Hanes
4,583,681 A 4/1986 Neese
4,718,557 A 1/1988 Friedman
4,746,052 A 5/1988 Schmissrauter
(Continued)

FOREIGN PATENT DOCUMENTS

DE 202005010894 9/2005
EP 743256 11/1996
(Continued)

*Primary Examiner* — Christopher Demeree

(74) *Attorney, Agent, or Firm* — Diederiks & Whitelaw, PLC; Gregory P. Kaihoi, Esq.

(57) ABSTRACT

An end load carton includes a closure system having a tab constituting part of a control region which is spaced from a free edge of an upper flap of the carton by a support region. The control region also includes a press zone adjacent the tab. After initially opening a top portion of the carton by releasing an adhesive connection between the upper flap and a lower flap, the tab can be positioned in a slot formed in the lower flap to reclose the carton. More specifically, the upper and lower flaps can be selectively interconnected through the closure system by pushing on the press zone to depress the upper and lower flaps in order to open up the slot and align the tab with the slot. To reopen the carton, the support region can be readily grasped and pulled to open carton without fear of tearing the upper flap.

19 Claims, 5 Drawing Sheets

(56) References Cited

U.S. PATENT DOCUMENTS

| | | | | |
|---|---|---|---|---|
| 5,755,377 | A | 5/1998 | Durand | |
| D396,805 | S | 8/1998 | Broyles | |
| 6,206,280 | B1 | 3/2001 | Thresher et al. | |
| 6,695,144 | B2 | 2/2004 | Freeze | |
| D548,590 | S | 8/2007 | Forthaus et al. | |
| D558,573 | S | 1/2008 | Forthaus et al. | |
| 8,408,451 | B2 | 4/2013 | Adam et al. | |
| 8,459,538 | B2 * | 6/2013 | Raeth et al. | 229/222 |
| 2012/0031959 | A1 | 2/2012 | Emmott | |

FOREIGN PATENT DOCUMENTS

| | | |
|---|---|---|
| GB | 1381847 | 8/1972 |
| JP | 8134406 | 5/1996 |
| JP | 11139427 | 5/1999 |
| JP | 11198927 | 7/1999 |
| JP | 2006206183 | 8/2006 |
| JP | 2009154955 | 7/2009 |
| JP | 2013-136395 | 7/2013 |

* cited by examiner

END LOAD CARTON WITH CLOSURE SYSTEM

FIELD OF THE INVENTION

The invention generally pertains to packaging products, particular food products, in cartons and, more specifically, to an end load carton incorporating a system enabling the carton to be readily and repeatedly opened and closed in a convenient and effective manner.

BACKGROUND OF THE INVENTION

In connection with shipping products, such as food products, from a manufacturer to a retail establishment, it is known to package the products in a carton, seal the carton, and ship the carton for delivery to a designated retail establishment. Although various materials could be used in making the cartons, the most common material employed is paperboard. In general, the paperboard is provided in the form of a blank which can be conveniently stored in a flat configuration but easily erected through a simple folding operation to establish an open-ended carton which can be filled and sealed, typically in an automated process. These cartons are not only lightweight and quite strong, but the paperboard is advantageously recyclable.

In some situations, the cartons are designed with a closure system which enables the carton to be opened and closed numerous times prior to depleting the products therein. For example, it is widely known to package cereal and other food products in end load cartons and to provide the cartons with closure systems operating between upper and lower flaps of top portions of the cartons. After this type of carton is initially unsealed, a tab projecting from the upper flap is designed to be slipped into a slot provided in the lower flap in order to re-close the carton for future access. However, it is not uncommon for a user to initially detach the upper and lower flaps by grasping the tab and pulling on the tab in attempting to overcome adhesive forces securing the upper and lower flaps. Unfortunately, this manner of opening the carton often leads to the tab being torn, thereby rendering the closure system unsatisfactory or even unsuitable for reclosure purposes. In fact, a common design actually provides for the tab extending from the remainder of the upper flap through obtuse angles, with the flap typically tearing at the vertexes of these angles.

A known prior art arrangement of this type is represented in FIGS. 1-3 wherein FIG. 1 shows an open ended carton 5 including a top portion 10 having an upper flap 15 adhered to a lower flap 20 such as in a sealed, shipping state. Upper flap 15 is formed with a central tab 25 which is provided for reclosure purposes and essentially established by forming a pair of generally V-shaped cutouts 30 and 31 at spaced locations along a free edge 35 of carton 10. Most often, a carton formed in this fashion is initially sealed with adhesive extending below end regions 40 and 41 of upper flap 15. As indicated above, it is quite common for a user to initially peel up tab 25, grip the same, and pull up on tab 25 in an attempt to separate upper flap 15 from lower flap 20. However, the adhesive can be quite strong, often leading to the area associated with tab 25 ripping from each vertex 45 associated with the cutouts 30 and 31 a substantially portion of upper flap 15 as represented by the tear lines 47 and 48 in FIGS. 2 and 3. When this occurs and tab 25 is later used to reclose open ended carton 5 through insertion into a slot 50 formed in lower flap 20, end regions 40 and 41 are really not pressed against lower flap 20 as intended, as represented in FIG. 3.

In addition to the above, prior known closure systems of this type are not considered to be particularly advantageous for use with individuals of all ages and levels of ability. For instance, individuals suffering from arthritis of the hands can find it particularly difficult to manipulate the tab in combination with the slot in repeatedly opening and closing such a carton. In any case, in light of these and other drawbacks, it would be desirable to provide an open end carton with a closure system which is at least significantly less prone to tearing and can be readily utilized by individuals of varying ages and abilities. In addition, it would be desirable to provide a closure system for an open ended carton wherein the system feels, and potentially even sounds, more secure than prior known systems, thereby providing a tactical feedback which can convey a sense of confidence to the user regarding the effectiveness of the closure system.

SUMMARY OF THE INVENTION

The invention is directed to an end load carton having a closure system including a tab constituting part of a control region which is spaced from a free edge of an upper flap of the carton by a support region of the closure system. The control region also includes a press zone adjacent the tab. After initially opening the carton by releasing an adhesive connection between the upper and a lower flap of the carton, the tab is configured to be received in a slot formed in the lower flap to reclose the carton. More specifically, the upper and lower flaps can be selectively interconnected through the closure system by pushing on the press zone to depress the upper and lower flaps in order to open up the slot and align the tab with the slot. To reopen the carton, the support region can be readily grasped and pulled to open carton without fear of tearing the upper flap.

With the ability of a user to pull on support region and press on control region in operating the closure system, the overall closure system can be easily manipulated by individuals of varying ages and abilities including both children and the elderly having arthritic or other limitations. In any case, additional objects, features and advantages of the invention will become more readily apparent from the following detailed description when taken in conjunction with the drawings wherein like reference numerals refer to corresponding parts in the several views.

DETAILED DESCRIPTION OF EMBODIMENTS

Figure 1:
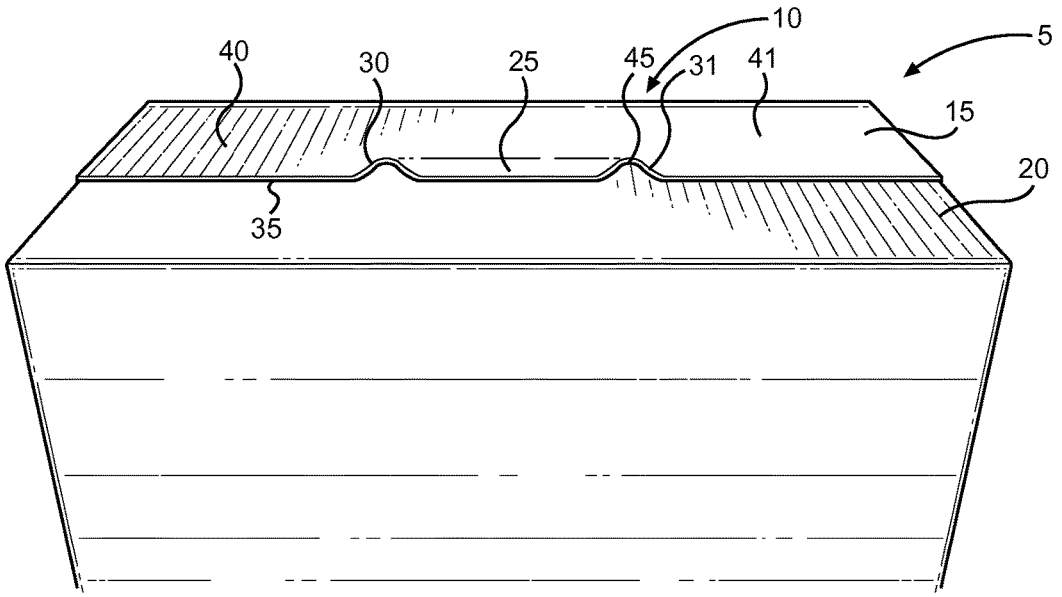
FIG. 1 PRIOR ART
FIG. 1 is a perspective view of an upper portion of a sealed end load carton including a closure system constructed in accordance with the prior art.
Figure 2:
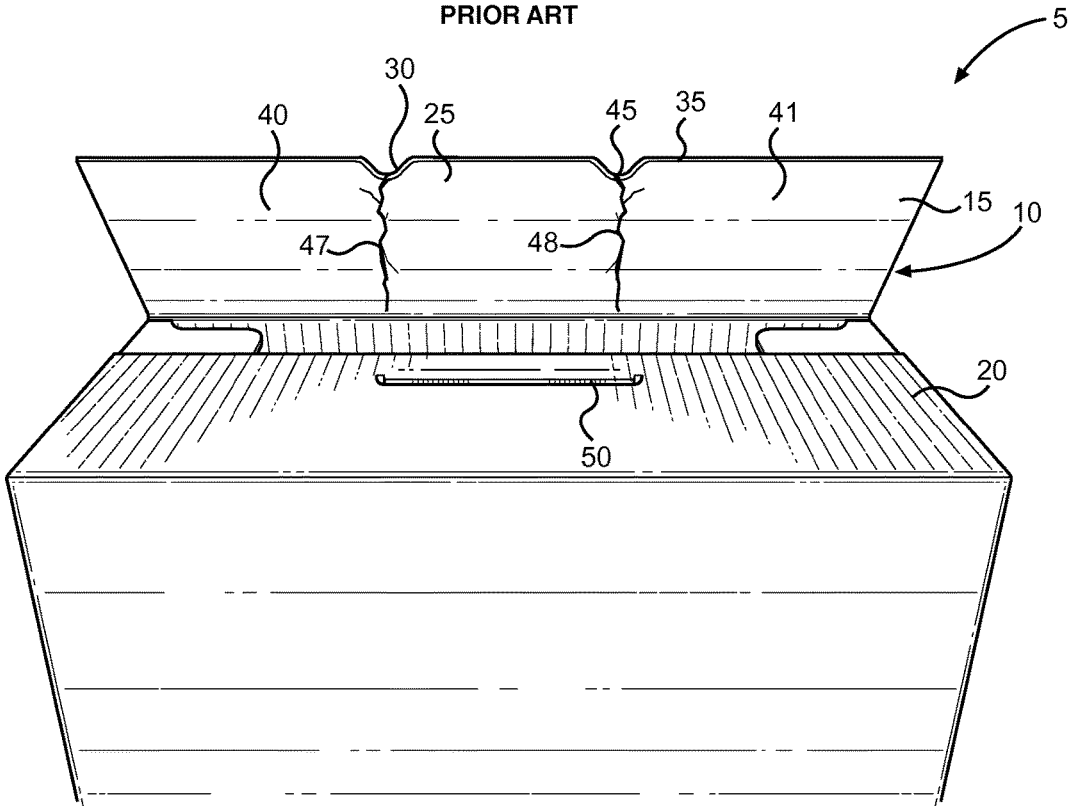
FIG. 2 PRIOR ART
FIG. 2 is a perspective view of the prior art end load carton of FIG. 1 in a partially open condition.
Figure 3:
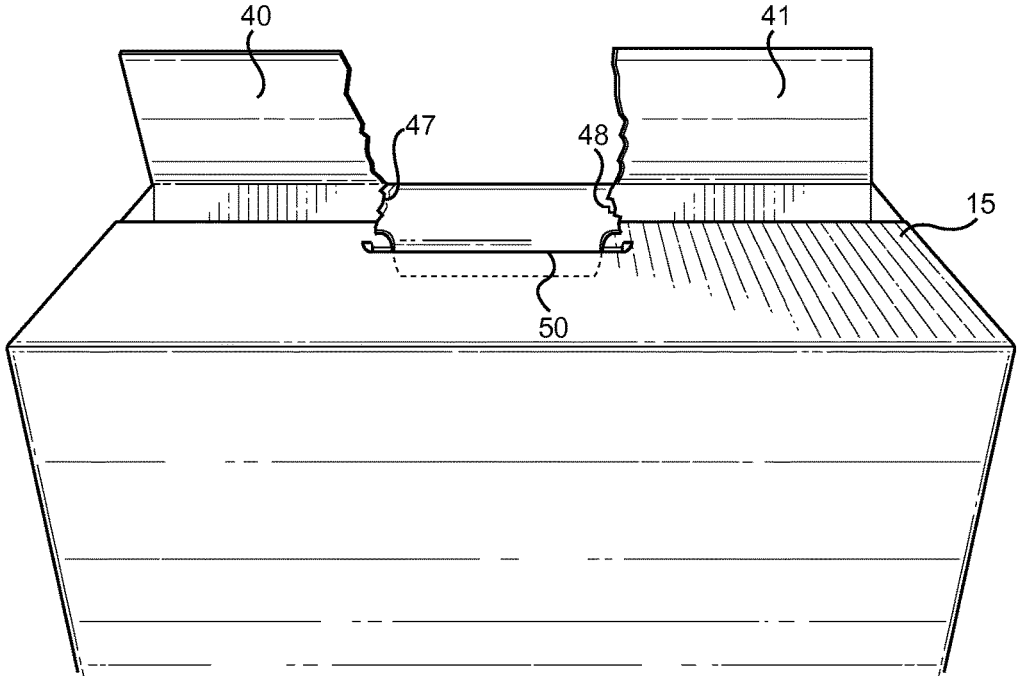
FIG. 3 PRIOR ART
FIG. 3 is a perspective view of the prior art end load carton of FIGS. 1 and 2, with the carton shown in a reclosed condition.
Figure 4:
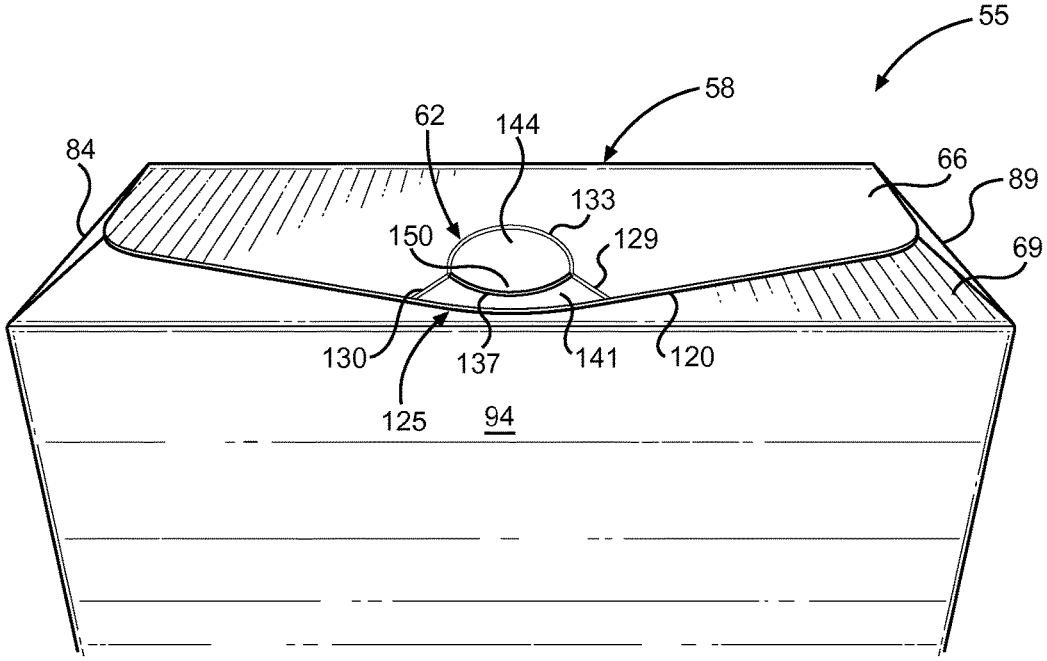
FIG. 4 is a perspective view of an upper portion of a sealed, end load carton including a closure system constructed in accordance with the present invention.

With initial reference to FIG. 4, an open ended carton constructed in accordance with the present invention is generally indicated at 55. Carton 55 includes a top portion 58 including a closure system 62 between an upper flap 66 and a lower flap 69. At this point, it should be noted that the use of terms, such as upper, lower, inner, outer, front, rear and the like, is for reference purposes only in describing exemplary forms of the invention as set forth herein and illustrated in the drawings. Therefore, these terms should not be considered limiting as to the overall invention.

Figure 5:
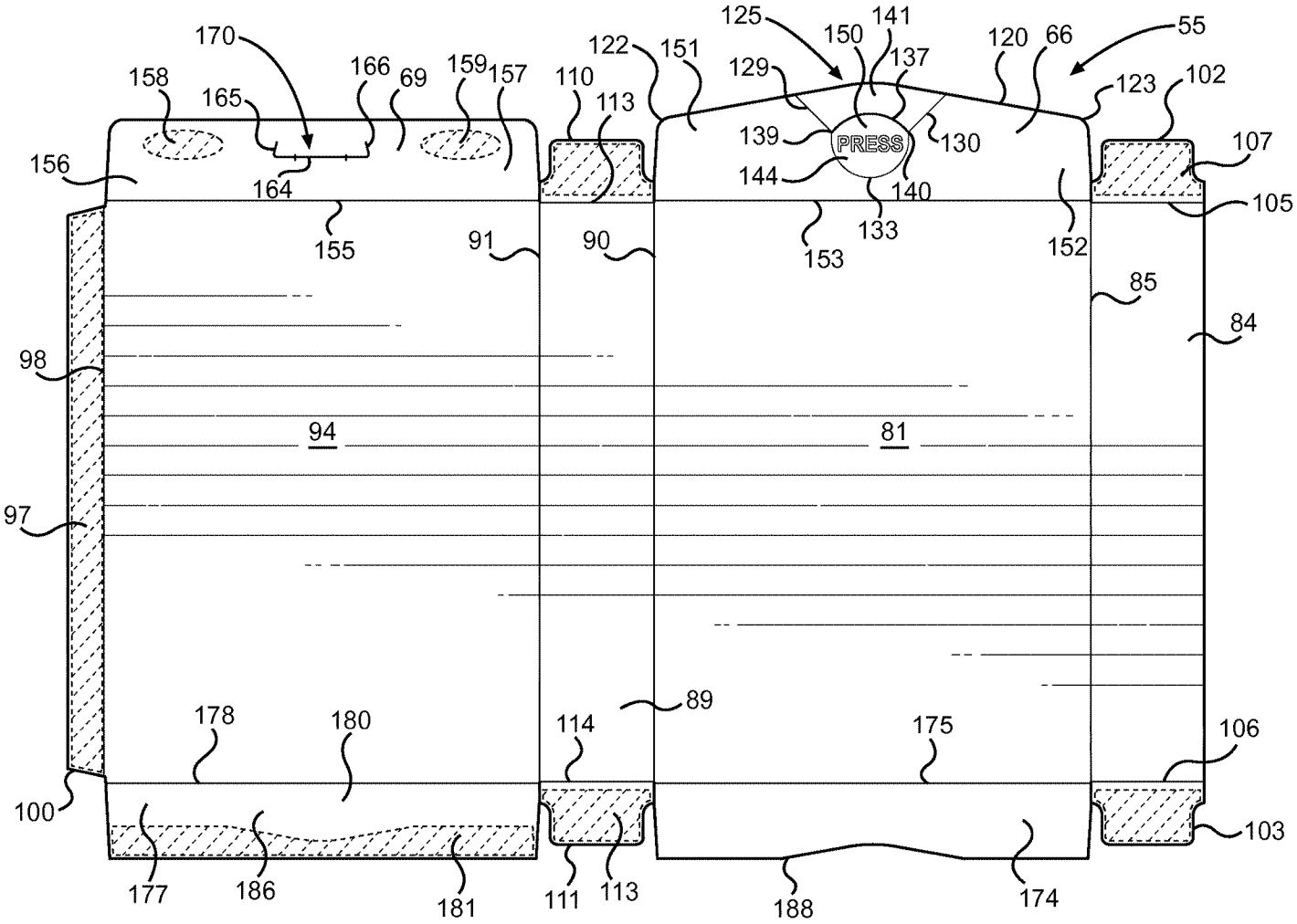
FIG. 5 is a plan view of a paperboard blank from which the carton of FIG. 4 is erected.

In accordance with a preferred embodiment, carton 55 is formed from a blank 78 as shown in FIG. 5. Blank 78 can be made from various materials, particularly paperboard which is known for use in the food industry for forming various types of food cartons, such as cereal boxes. In any case, blank 78 is stamped from a single sheet to establish a first or front face panel 81 which is connected to a first side panel 84 along a fold line 85. On another side of first face panel 81 is established a second side panel 89 which is connected with first face panel 81 through a fold line 90. Second side panel 89 also has associated therewith a fold line 91 which connects second side panel 89 to a second or rear face panel 94. On an opposing side of second face panel 94 is formed a connecting flap 97 which also has an associated fold line 98. In the embodiment depicted, connecting flap 97 has tapered ends such as indicated at 100.

First side panel 84 also has associated therewith an upper connecting flap 102 and a lower connecting flap 103. Each of connecting flaps extend from first side panel 84 along a respective fold line 105, 106 and is provided thereon with adhesive as generally indicated at 107 for upper connecting flap 102. In a similar manner, second side panel 89 is joined to an upper connecting flap 110 and a lower connecting flap 111 through respective fold lines 113 and 114. In a similar manner to upper and lower connecting flaps 102 and 103, upper and lower connecting flaps 110 and 111 are also provided with adhesive, such as indicated at 115.

As illustrated in this figure, upper flap 66 has a free edge 120 which is contoured to include rounded ends 122 and 123, as well as a central apex region 125 which is preferably radiused. Although the overall contour can vary in accordance with the invention, a generally smooth contour is desired such that no sharp points or tear initiation points exist. From free edge 120 in the area of central apex region 125, upper flap 66 is formed with inwardly angled score lines 129 and 130. Score lines 129 and 130 are linked through an arcuate base score line 133. In addition, a cut line 137 extends entirely through upper flap 66 between inner terminal ends 139 and 140 of score lines 129 and 130. With this construction, upper flap 66 is formed with a support region 141 extending from central apex region 125, between angled score lines 129 and 130, to cut line 137. In addition, upper flap 66 defines a control region 144 between cut line 137 and arcuate base score line 133. Due to the presence of cut line 137, control region 144 has a free end (not separately labeled). Between terminal ends 139 and 140 of cut line 137 and along the free end of control region 144, a tab 150 of closure system 62 is established. More specifically, control region 144 is constituted by tab 150 and an adjacent press zone (not separately labeled) as will be more detailed further below.

As also shown in this figure, upper flap 66 has end regions 151 and 152 on either side of both support region 141 and control region 144. In addition, upper flap 66 is connected to first face panel 81 along a fold line 153. In a manner generally similar to first face panel 81, lower flap 69 of second face panel 94 is connected to second face panel 94 along a fold line 155 and includes end regions 156 and 157. As illustrated, lower flap 69 is provided with outwardly spaced adhesive zones 158 and 159, which are generally shown to be oval in shape, in end regions 156 and 157 respectively and can be established with the use of a wide range of adhesives, including glue, double-sided or pressure sensitive tape or the like. At this point, it should be noted that adhesive zones 158 and 159 are not limited to this particular shape, but are limited to certain areas and smaller in size compared to adhesive regions typically provided on cartons of this type. In addition, a preferred embodiment of the invention has cut lines about both adhesive zones 158 and 159. That is, lower flap 69 is cut partially through its overall thickness, e.g., half way through the thickness of lower flap 69, about both adhesive zones 158 and 159 for reasons which will be detailed below. Between adhesive zones 158 and 159, lower flap 69 is provided with a cut line defined by a longitudinal segment 164 and pair of spaced upwardly and inwardly (based on the view shown) extending legs 165 and 166. With this arrangement, the area between legs 165 and 166 is still attached to the remainder of lower flap 69 and, along longitudinal segment 164, a slot 170 is established.

Carton 55 also has a bottom portion 172 which, in addition to connecting flaps 103 and 111, includes an outer flap 174 connected to first face panel 81 along a fold line 175 and an inner flap 177 connected to second face panel 94 along a fold line 178. As for inner flap 177, this part of carton 55 is formed with a contoured region 180 that extends away from second face panel 94 from a fold line 178, as well as an edge portion 181 which establishes an adhesive region. Contoured region 180 is provided with an arcuate central zone 186 which is convex in nature and establishes a corresponding concave curvature to part of edge portion 181. For reasons which will be detailed more fully below, this curvature mimics a lower most edge 188 of outer flap 174 of first face panel 81.

With this arrangement, carton 55 can be formed by folding blank 78 along fold lines 85, 89, 91 and 98 such that first face panel 81 and second face panel 94 are spaced by second side panel 89 and extend substantially parallel to each other. In a similar fashion, first side panel 84 will be arranged opposite to second side panel 89 and will extend over connecting flap 97 so as to be secured thereto by the adhesive provided on connecting flap 97. Lower flaps 103 and 111 are folded inward relative to both first face panel 81 and second face panel 94 and then inner flap 177 of second face panel 94 is folded so as to extend over and be adhesively secured to lower flaps 103 and 111. Thereafter, the outer flap 174 of first face panel 81 is folded upon the inner flap 177 of second face panel 94 and secured thereto based on the adhesive on edge portion 181 of inner flap 177 of second face panel 94. Given the contoured nature of the adhesive provided on the inner flap 177, a secure arrangement is provided along the length of edge portion 181. At this point, carton 55 has an open top and can be readily filled with product, such as various types of food products, including cereal. Thereafter, upper connecting flaps 102 and 110 are folded inward, lower flap 69 is seated upon connecting flaps 102 and 110 and then upper flap 66 is adhesively attached at adhesive zones 158 and 159 to lower flap 69 to complete the packaging arrangement.

Figure 7:
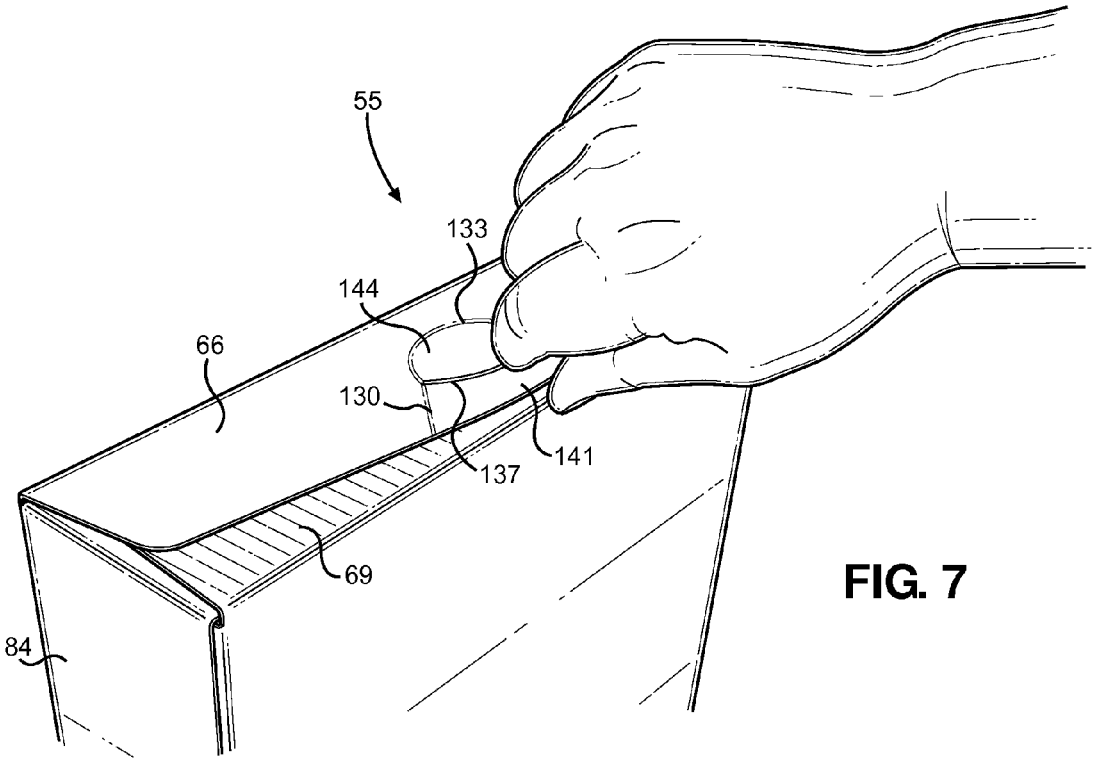
FIG. 7 illustrates an individual opening the closure system of either of FIG. 4 or 6.

In accordance with the present invention, it is important that closure system 62 can be utilized to repeatedly open and close carton 55. More specifically, upon initially opening carton 55, the adhesive connections between upper flap 66 and lower flap 69 through space adhesive zones 158 and 159 are overcome and then closure system 62 is utilized. When initially opening carton 55, the cuts made partially through lower flap 69 around adhesive zones 158 and 159 aid in preventing damage to upper flap 66 during this process. That is, when initially sealed, carton 55 takes the form illustrated in FIG. 4. Carton 4 but can be initially opened with a user grasping support region 141 and pulling up on upper flap 66, such as indicated in FIG. 7. With the cuts provided about adhesive zones 158 and 159, the fiber of upper flap 66 remains intact. Rather, layer portions of lower flap 69 at the adhesive zones 158 and 159 will tear and remain affixed to upper flap 66, while tear propagation will be avoided. Given the minimal size and location of adhesive zones 158 and 159, the required opening force will be reduced.

Figure 6:
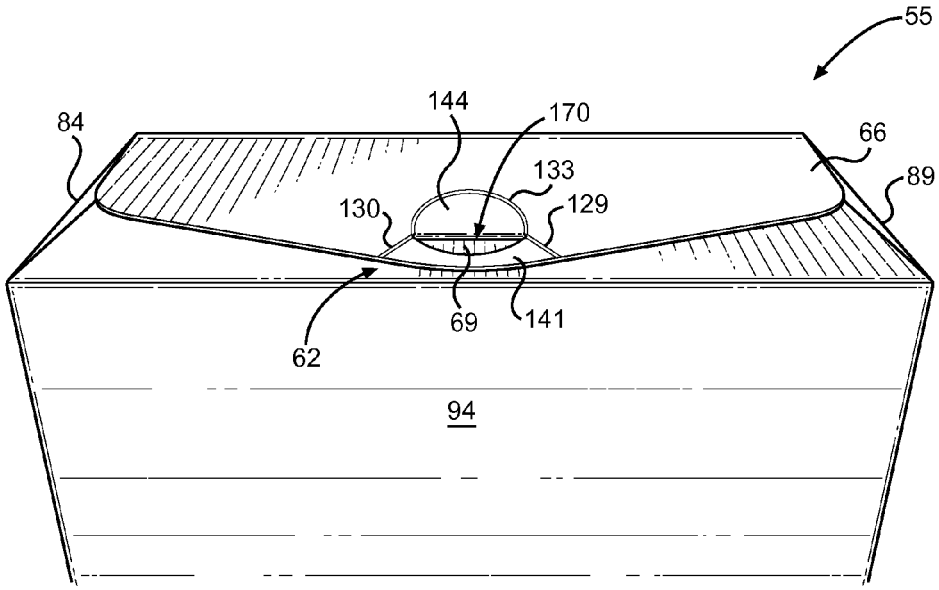
FIG. 6 is a perspective view, similar to that of FIG. 4, but showing the carton in a reclosed condition through the use of the closure system of the invention.

When it is desired to again close carton 55, the press zone of control region 144 is pressed to deflect upper and lower flaps 66 and 69 until tab 150 becomes aligned with and received in slot 170. Thereafter, releasing control region 144 will establish the reclosed condition shown in FIG. 6 wherein tab 150 extends within slot 170 and below lower flap 69. When it is desired to reopen carton 55, support region 141 is then grasped as indicated in FIG. 7 and pulled to remove tab 150 from within slot 170. Notably, the use of the paperboard for blank 78, the formation of tab 150 out of control region 144 and the cooperation of tab 150 with the structure establishing slot 170 provides a rigorous interconnection which actually results in a snapping sound upon release. The development of this sound is seen to be advantageous as it establishes an audible feedback signal to a user and increases the user's level of confidence of both the overall effectiveness and robustness of closure system 62.

Figure 8:
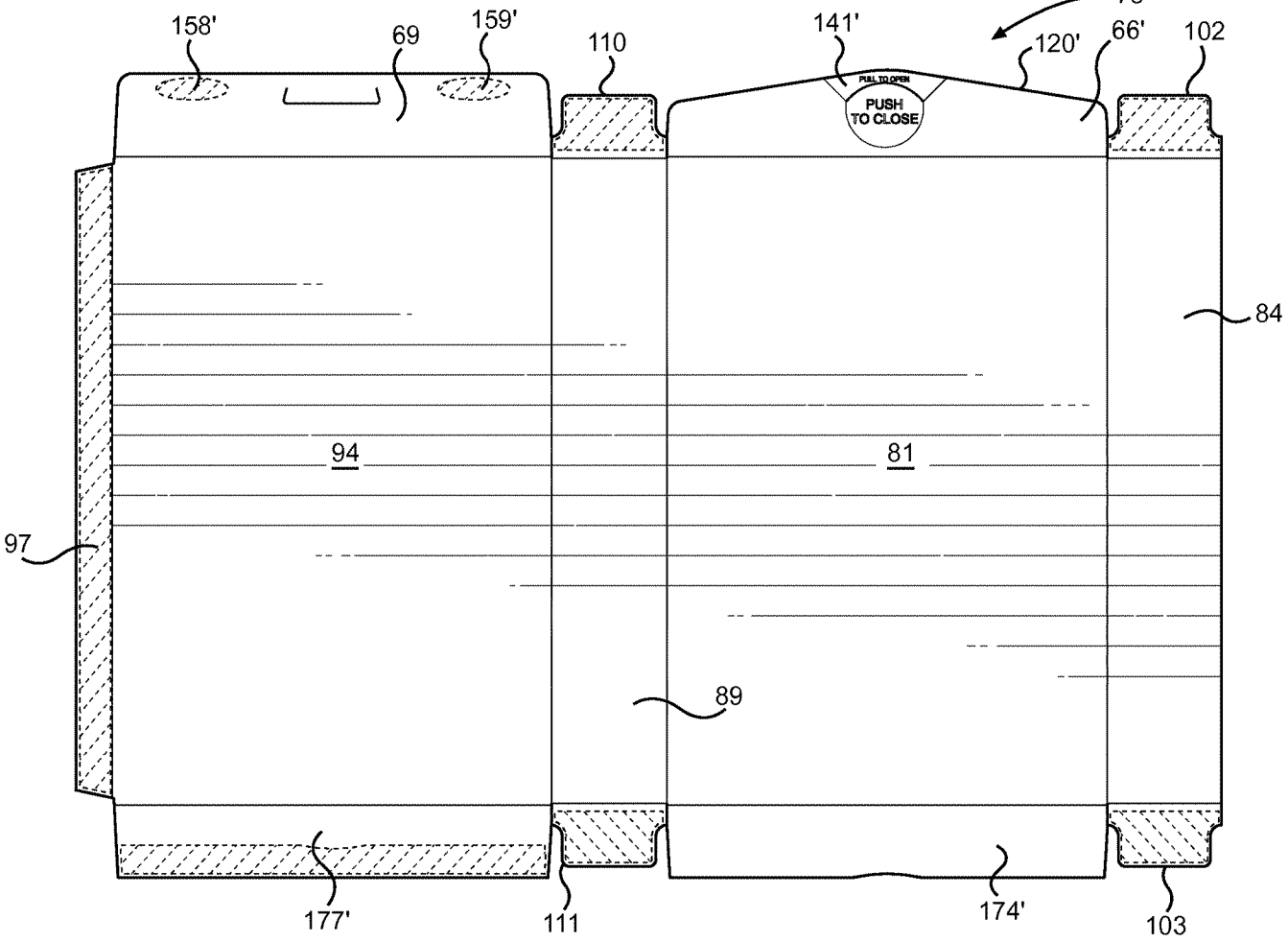
FIG. 8 is a plan view, similar to that of FIG. 5, but showing a paperboard blank for a carton incorporating a modified version of the closure system.

Based on the above, it should be readily apparent that the invention provides for an end load carton with an enhanced closure system. Given the construction of closure system 62 and the characteristics of adhesive zones 158 and 159, support region 141 can readily be pulled to open carton 55 without fear of tearing upper flap 66. The inclusion of the various score lines 129, 130 and 133 advantageously makes the support region 141 more pliable and able to flex when being manipulated. In addition, particularly with the ability of a user to pull on support region 141 and press on part of the control region 144 in operating closure system 62, the overall closure system 62 can be easily manipulated by a user, even individuals of varying ages and abilities including both children and the elderly having arthritic or other limitations. Furthermore, the contour of the outer flap 174 is made to generally be a mirror image of central apex region 125, thereby saving material when forming multiple cartons from a single blank. Of course, the central apex region can take various different forms, as well as corresponding changes in the outer flap. For instance, FIG. 8 shows a modified version of the carton of the invention formed from a blank 78' having a free edge 120' which is more flattened, resulting in a reduced support region 141', small adhesive zones 158' and 159', a moderately shaped outer flap 174' for the first face panel 81 and a correspondingly configured inner flap 177'. Basically, it is desired to form the outer flap 174, 174' with a generally convex curvature all the way across the free edge 120, 120' so as to be void of any tear initiation points. Regardless, the tab associated with the closure system is still recessed from the free edge of the upper flap and a support region is connected thereto through score lines which provides for a pliable handle for use in opening the closure system in an efficient and effective manner. Certainly, additional variations are possible to even further enhance this feature. For instance, with reference to either FIG. 4 or 8, the control region can be debossed so as to extend below a plane of the upper flap while the score lines are embossed. With this arrangement, it is even easier to see where to push the control region for closure purposes and the support region even sits up off the lower flap a bit such that the support region is easier to grab when opening the closure system. In any case, although disclosed with the reference to preferred embodiments of the invention, is should be readily apparent that various changes and modifications can be made to the invention without departing from the spirit thereof. Instead, the invention is only intended to be limited by the scope of the following claims.

The invention claimed is:

1. An end load carton comprising:

front, rear, bottom and opposing side panels interconnected to establish an open top portion for loading and unloading the carton;

first and second flaps for selectively covering the open top portion; and a closure system for selectively interconnecting the first and second flaps across the open top portion to cover the open top portion after initially opening the carton, said closure system including a tab formed in the first flap, a slot formed in the second flap and a control region having a free end portion spaced from the free edge of the first flap by a support region, with the tab constituting part of the control region and being defined, at least in part, by the free end portion while being spaced from a free edge of the first flap by the support region which remains attached to the first flap as the first flap is moved between an open position and a closed position in which the tab is configured to be received in the slot upon covering the open top portion with the first and second flaps.

2. The carton of claim 1, wherein the control region is formed from the tab and a press zone, with the first and second flaps being adapted to be interconnected through the closure system by pushing on the press zone to depress the first and second flaps in order to open up the slot and align the tab with the slot.

3. The carton of claim 2, wherein closure system is configured to be released to expose the open top portion of the carton by grasping and pulling on the support portion.

4. The carton of claim 1, wherein the first flap is formed with a plurality of score lines establishing, along with the free end portion, the support and control regions.

5. The carton of claim 4, wherein the plurality of score lines includes first and second angled score lines extending from the free edge and an arcuate base score line interconnecting the first and second angled score lines and extending about the control region.

6. The carton of claim 5, wherein the control region is entirely confined within the arcuate base score line and the free end portion.

7. The carton of claim 1, wherein the first and second flap portions include end regions spaced from the closure system and are initially sealed to close the carton by adhesive provided in shaped attachment zones established in the end regions.

8. The carton of claim 7, wherein first flap is cut, only partially through a thickness thereof, about the attachment zones.

9. The carton of claim 1, wherein the bottom panel is formed from interconnected flaps, with an exposed one of the interconnected flaps having an edge portion which is contoured in correspondence to the free edge of the first flap.

10. The carton of claim 1, wherein the free edge of the first flap has a generally convex curvature all the way across the carton such that the free edge is void of tear initiation points.

11. An end load carton comprising:

a front panel;

a rear panel;

opposing side panels;

a bottom;

a top portion defined by upper and lower flaps; and a closure system for selectively interconnecting the upper and lower flaps across an open top of the carton, said closure system including a slot formed in the lower flap, a support region attached for movement with and extending from a free edge of the upper flap, and a control region spaced from the support region by a cut line provided in the upper flap, said control region including a tab defined, at least in part, by the cut line and configured to be received in the slot when the upper flap is moved from an open position to a closed position.

12. The carton of claim 11, wherein the control region is formed from the tab and a press zone, with the first and second flaps being adapted to be interconnected through the closure system by pushing on the press zone to depress the first and second flaps in order to open up the slot and align the tab with the slot.

13. The carton of claim 12, wherein closure system is configured to be released to expose the open top of the carton by grasping and pulling on the support region.

14. The carton of claim 13, wherein the upper flap is formed with a plurality of score lines establishing, along with the cut line, the support and control regions.

15. The carton of claim 14, wherein the plurality of score lines includes first and second angled score lines extending from the free edge and an arcuate base score line interconnecting the first and second angled score lines and extending about the control region.

16. The carton of claim 15, wherein the control region is entirely confined within the arcuate base score line and the cut line.

17. A method of selectively closing and opening an openable top portion of an end loaded carton including interconnected front, rear, bottom and opposing side panels comprising:

after initially opening the carton, closing the openable top portion by interconnecting upper and lower flaps across the openable top portion by pushing on a control region formed in the upper flap to depress the first and second flaps and open up a slot formed in the lower flap, followed by releasing the control region such that a tab of the control region is received with the slot; and opening the openable top portion by grasping and pulling on a support region, which is established between a free end of the upper flap and the control region and remains attached to the upper flap as the upper flap is moved between a closed position and an open position, to lift the upper flap and slip the tab from within the slot.

18. The method of claim 17, further comprising: flexing the support region along score lines upon pulling on the support region.

19. The method of claim 17, further comprising: providing an audible feedback signal, stemming from the tab being released from within the slot, upon opening the openable end.

* * * * *